US010335652B2

(12) United States Patent
Wallans

(10) Patent No.: US 10,335,652 B2
(45) **Date of Patent: *Jul. 2, 2019**

(54) GOLF CLUB HEAD

(71) Applicant: SRI SPORTS LIMITED, Kobe-shi, Hyogo (JP)

(72) Inventor: Michael J. Wallans, Huntington Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/637,676

(22) Filed: Jun. 29, 2017

(65) Prior Publication Data

US 2017/0296883 A1 Oct. 19, 2017

Related U.S. Application Data

(63) Continuation of application No. 14/715,038, filed on May 18, 2015, now Pat. No. 9,724,576, which is a continuation of application No. 13/886,561, filed on May 3, 2013, now Pat. No. 9,056,231, which is a continuation of application No. 13/158,197, filed on Jun. 10, 2011, now Pat. No. 8,454,452, which is a continuation of application No. 12/344,003, filed on Dec. 24, 2008, now Pat. No. 8,057,322.

(51) Int. Cl.
*A63B 53/04* (2015.01)
*A63B 60/54* (2015.01)

(52) U.S. Cl.
CPC ..... *A63B 53/047* (2013.01); *A63B 53/04* (2013.01); *A63B 60/54* (2015.10); *A63B 2053/0416* (2013.01); *A63B 2053/0491* (2013.01); *A63B 2209/00* (2013.01)

(58) Field of Classification Search
CPC ..... A63B 60/54; A63B 53/047; A63B 2053/0416; A63B 2053/0491; A63B 2209/00; A63B 53/04
USPC ..... 473/324–350, 287–292
See application file for complete search history.

(56) References Cited

U.S. PATENT DOCUMENTS 2,846,228 A 8/1958 Reach
4,027,885 A * 6/1977 Rogers ..... A63B 53/04 473/342
4,667,963 A * 5/1987 Yoneyama ..... A63B 53/04 473/348

(Continued)

OTHER PUBLICATIONS

Jul. 28, 2016 Office Action Issued in U.S. Appl. No. 14/715,038.

(Continued)

*Primary Examiner* — Sebastiano Passaniti
(74) *Attorney, Agent, or Firm* — Oliff PLC

(57) ABSTRACT

An iron-type golf club head according to one or more aspects of the present disclosure may include a striking face, a rear surface opposite the striking face, and a perimeter weighting element at least partially surrounding the rear surface. The club head may further include a resilient component associated with the perimeter-weighting element, the resilient component including a recess, and a preload spacer associated with the rear surface, a portion of the preload spacer engaging the recess. At least a portion of the resilient component is compressed between the preload spacer and the perimeter weighting element.

17 Claims, 18 Drawing Sheets

(56) References Cited

U.S. PATENT DOCUMENTS

| | | | | |
|---|---|---|---|---|
| 4,792,139 | A | 12/1988 | Nagasaki et al. | |
| 4,798,383 | A | 1/1989 | Nagasaki et al. | |
| 4,848,747 | A | 7/1989 | Fujimura et al. | |
| 4,883,274 | A | 11/1989 | Hsien | |
| 4,884,812 | A | 12/1989 | Nagasaki et al. | |
| 4,928,972 | A | 5/1990 | Nakanishi et al. | |
| 4,964,640 | A | 10/1990 | Nakanishi et al. | |
| 5,290,036 | A | 3/1994 | Fenton et al. | |
| 5,297,794 | A | 3/1994 | Lu | |
| 5,409,229 | A | 4/1995 | Schmidt et al. | |
| 5,605,511 | A | 2/1997 | Schmidt et al. | |
| 5,800,282 | A | 9/1998 | Hutin et al. | |
| 6,491,593 | B2 | 12/2002 | Takeda | |
| 6,592,469 | B2 | 7/2003 | Gilbert | |
| 6,688,989 | B2 | 2/2004 | Best | |
| 6,743,117 | B2 | 6/2004 | Gilbert | |
| 6,835,144 | B2 | 12/2004 | Best | |
| 6,875,124 | B2 | 4/2005 | Gilbert et al. | |
| 6,902,495 | B2 | 6/2005 | Pergande et al. | |
| 6,921,344 | B2 | 7/2005 | Gilbert et al. | |
| 6,923,732 | B2 | 8/2005 | Stites et al. | |
| 6,929,563 | B2 | 8/2005 | Nishitani | |
| 7,186,188 | B2 | 3/2007 | Gilbert et al. | |
| 7,192,361 | B2 | 3/2007 | Gilbert et al. | |
| 7,192,362 | B2 | 3/2007 | Gilbert et al. | |
| 7,201,669 | B2 | 4/2007 | Stites et al. | |
| 7,232,377 | B2 | 6/2007 | Gilbert et al. | |
| 7,273,418 | B2 | 9/2007 | Gilbert et al. | |
| 7,316,623 | B2 * | 1/2008 | Imamoto | A63B 53/047 473/332 |
| 7,371,190 | B2 | 5/2008 | Gilbert et al. | |
| 7,597,633 | B2 | 10/2009 | Shimazaki et al. | |
| 7,789,771 | B2 | 9/2010 | Park et al. | |
| 7,980,960 | B2 | 7/2011 | Gilbert et al. | |
| 8,057,322 | B2 | 11/2011 | Wallans | |
| 8,187,117 | B2 | 5/2012 | Blumenkrantz et al. | |
| 8,192,301 | B2 | 6/2012 | Park et al. | |
| 8,366,567 | B2 | 2/2013 | Park et al. | |
| 8,454,452 | B2 | 6/2013 | Wallans | |
| 9,056,231 | B2 | 6/2015 | Wallans | |
| 9,724,576 | B2 * | 8/2017 | Wallans | A63B 53/047 |
| 2003/0092502 | A1 | 5/2003 | Pergande et al. | |
| 2004/0242339 | A1 | 12/2004 | Gilbert et al. | |
| 2005/0148407 | A1 | 7/2005 | Gilbert et al. | |
| 2006/0030425 | A1 | 2/2006 | Sukman | |
| 2006/0166758 | A1 | 7/2006 | Roberts et al. | |
| 2006/0234805 | A1 | 10/2006 | Gilbert et al. | |
| 2006/0258480 | A1 | 11/2006 | Hou et al. | |
| 2007/0129166 | A1 * | 6/2007 | Shimazaki | A63B 53/047 473/345 |
| 2007/0155534 | A1 | 7/2007 | Tsai et al. | |
| 2007/0191134 | A1 | 8/2007 | Gilbert et al. | |
| 2008/0026866 | A1 | 1/2008 | Gilbert et al. | |
| 2008/0051220 | A1 * | 2/2008 | Soracco | A63B 53/047 473/350 |
| 2008/0058119 | A1 | 3/2008 | Soracco et al. | |
| 2008/0058120 | A1 | 3/2008 | Roberts et al. | |
| 2011/0070970 | A1 * | 3/2011 | Wan | A63B 53/047 473/335 |

OTHER PUBLICATIONS

Nov. 17, 2016 Office Action issued in U.S. Appl. No. 14/715,038.
Sep. 3, 2010 Office Action issued in U.S. Appl. No. 12/344,003.
Feb. 15, 2011 Office Action issued in U.S. Appl. No. 12/344,003.
Nov. 17, 2011 Office Action issued in U.S. Appl. No. 12/550,108.
May 22, 2012 Office Action issued in U.S. Appl. No. 13/158,197.
Aug. 29, 2012 Office Action issued in U.S. Appl. No. 13/158,197.
Aug. 14, 2014 Office Action issued in U.S. Appl. No. 13/886,561.

* cited by examiner

GOLF CLUB HEAD

This is a Continuation of application Ser. No. 14/715,038 filed, May 18, 2015, which is a Continuation of application Ser. No. 13/886,561 filed May 3, 2013, which is a Continuation of application Ser. No. 13/158,197 filed Jun. 10, 2011 (now U.S. Pat. No. 8,454,452 issued Jun. 4, 2013), which is a Continuation of application Ser. No. 12/344,003 filed Dec. 24, 2008 (now U.S. Pat. No. 8,057,322 B2 issued Nov. 15, 2011). The prior applications, including the specifications, drawings and abstracts are incorporated herein by reference in their entirety.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Iron-type golf club heads may generally be classified into "blade" and "perimeter-weighted" categories. Perimeter-weighted iron-type club heads may have a substantial concentration of mass distributed behind the striking face in the form of at least one peripheral wall, sometimes called the perimeter-weighting element. A perimeter-weighted iron-type golf club head may also be referred to as a "cavity-back" iron head, or simply a "cavity-back", because the perimeter-weighting element generally delimits a cavity in the rear portion of the club head opposite the striking face.

SUMMARY

An important performance aspect of cavity-back irons is the tactile feedback communicated to the player at ball impact. To reduce undesirable dynamic excitation synonymous with mishit shots, the perimeter-weighting element of a cavity-back club head may be provided with a complimentary vibration-damping member. A secure coupling of the vibration-damping member to the club head may require that features for retention of the vibration-damping member be integrally incorporated into the head. The added weight of these retention features may adversely affect the mass properties of the club head, negatively impacting performance. Moreover, potentially complex geometries of the retention features may increase manufacturing complexity and cost.

The present invention, in one or more aspects thereof, may advantageously comprise a golf club head having enhanced tactile feedback, augmented performance, and improved structural integrity.

In one example, a golf club head, according to one or more aspects of the present invention, may include a strike face, a rear wall behind the strike face, and a perimeter-weighting element at least partially surrounding the rear wall. The club head may further include a preload spacer, associated with the rear wall, and a resilient component, having a recess. The resilient component may be associated with the perimeter-weighting element. A portion of the preload spacer may be disposed in the recess of the resilient component, whereby the preload spacer biases the resilient component against a portion of the perimeter-weighting element.

In another example, a golf club head, according to one or more aspects of the present invention, may include a strike face, a rear wall behind the strike face, and a perimeter-weighting element at least partially surrounding the rear wall. The club head may further include a preload spacer associated with the rear wall and a resilient component, associated with the perimeter-weighting element. The resilient component may include a projection for engaging a portion of the preload spacer.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

DETAILED DESCRIPTION

Figure 1A:
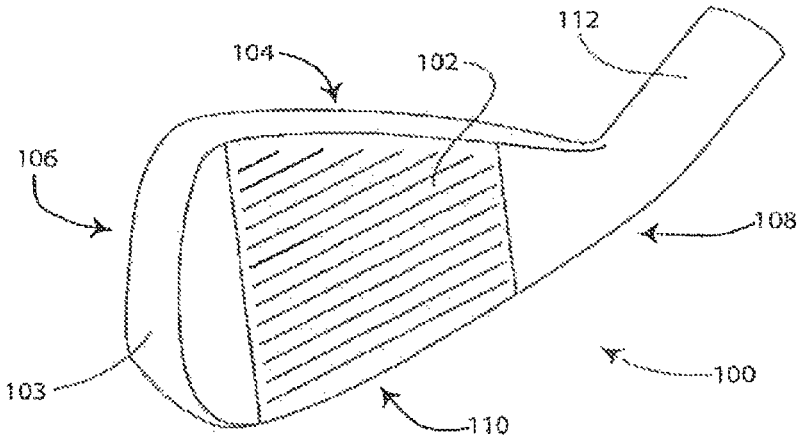
FIG. 1*a* is a front perspective view of an exemplary golf club head according to one or more aspects of the present invention.
Figure 1B:
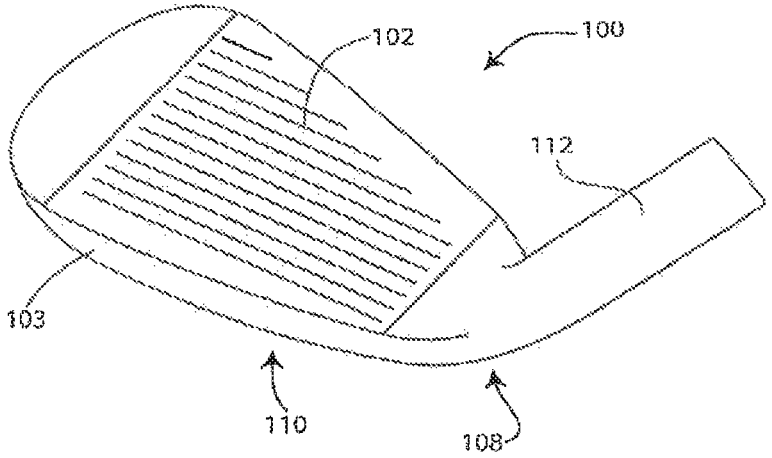
FIG. 1*b* is a front perspective view of the golf club head of FIG. 1*a*.
Figure 1C:
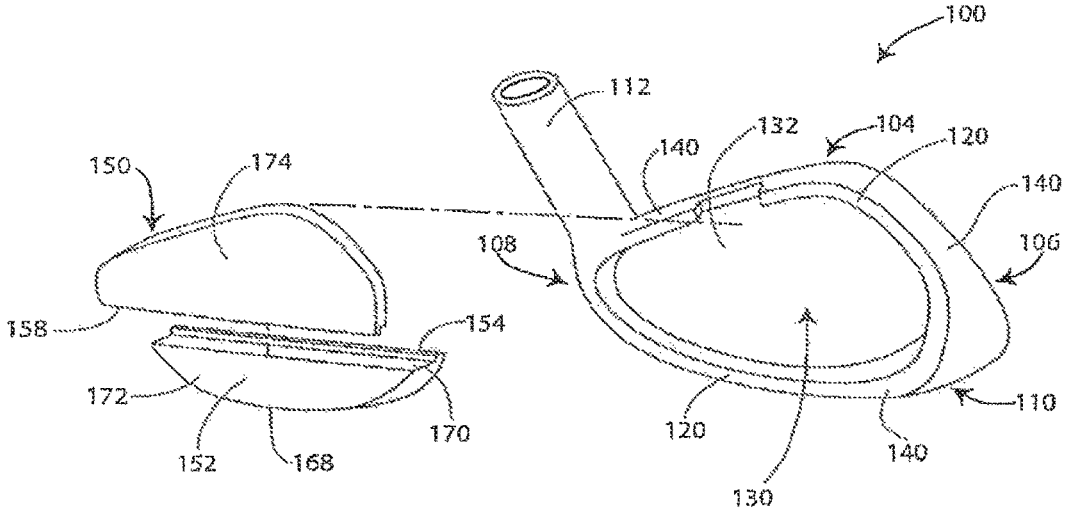
FIG. 1*c* is an exploded view of the golf club head of FIG. 1*a*.

Referring to FIGS. 1*a* and 1*b*, a golf club head 100, according to one or more aspects of the present invention, may generally comprise a strike face 102 and a body 103 having a top line 104, a toe 106, a heel 108, and a bottom portion 110. The strike face 102 may be integral with the body 103, or joined thereto, e.g., by mechanical interlocking, welding, brazing, or adhesive bonding. A hosel 112 may extend from the body 103 to receive a shaft (not shown). As illustrated in FIG. 1*c*, the club head 100 may further include a main cavity 130, which is delimited by a rear wall 132 surrounded, at least in part, by a perimeter-weighting element 140 that includes a rear surface 120. The rear wall 132 is located behind the strike face 102. Suitable materials for fabricating the golf club head 100 may include, e.g., carbon steel, stainless steel, 6-4 titanium alloy, 10-2-3 Beta-C titanium alloy, 6-22-22 titanium alloy, or the like.

Figure 1D:
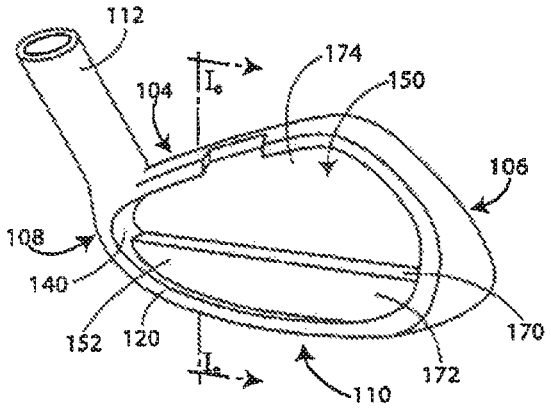
FIG. 1*d* is a rear perspective view of the golf club head of FIG. 1*a*.

As shown in FIGS. 1*c* and 1*d*, a resilient component 152, which may serve as an example of a "first insert" or "resilient insert," may be associated with the perimeter-weighting element 140, e.g., to reduce undesirable vibration, correlated with mishit shots. The resilient component 152 may be made, e.g., from a material having a Shore hardness less than about 100 A, preferably less than about 90 A, and more preferably less than about 80 A. In one or more aspects of the present invention, the compliance of the resilient component may be tactilely perceptible, thus suggesting to the player that the golf club possesses beneficial dynamic-excitation response characteristics at ball impact and, accordingly, promoting increased player confidence in the equipment.

Examples of the materials suitable for fabricating the resilient component 152 may include polyurethane, silicone, Acrylonitrile Butadiene Styrene (ABS), Nylon, polycarbonate (PC), polypropylene (PP), polyethylene (PE), thermoplastic rubber (TPR), thermoplastic vulcanizate (TPV), thermoplastic elastomers (TPE), and natural rubber. In another example, the resilient component 152 may be made from thermoplastic polyurethane (TPU), having a Shore hardness between about 65 A and about 75 A. The specific gravity of the resilient component may depend on the material selected and may generally be between about 0.8 and about 2.0. Alternatively, the resilient component 152 may be densified by blending an elastic material with a higher-density substance, e.g., powdered tungsten. The specific gravity of the densified insert may be in a range from about 0.8 to about 15. Accordingly, the resilient component may be used to alter the weight distribution of the club head.

Figure 1E:
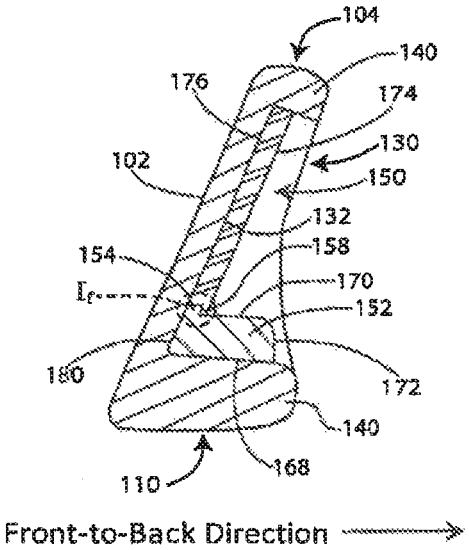
FIG. 1*e* is a cross-sectional view taken along the lines $I_e$-$I_e$ of FIG. 1*d*.

Referring again to FIG. 1*c* and to FIG. 1*e*, which shows the club head 100 along a front-to-back direction, the resilient component 152 may include a top surface 170, a bottom surface 168, a back surface 180 (FIG. 1*e*), and a front surface 172. The bottom surface 168 may be bonded to the perimeter-weighting element 140 by using, e.g., an epoxy-type adhesive. Additionally, the back surface 180 may be at least partially adhesively coupled to the rear wall 132 of the club head 100. The top surface 170 of the resilient component 152 may include a projection 154 (FIGS. 1*c*, 1*e*, and 1*f*).

Figure 1F:
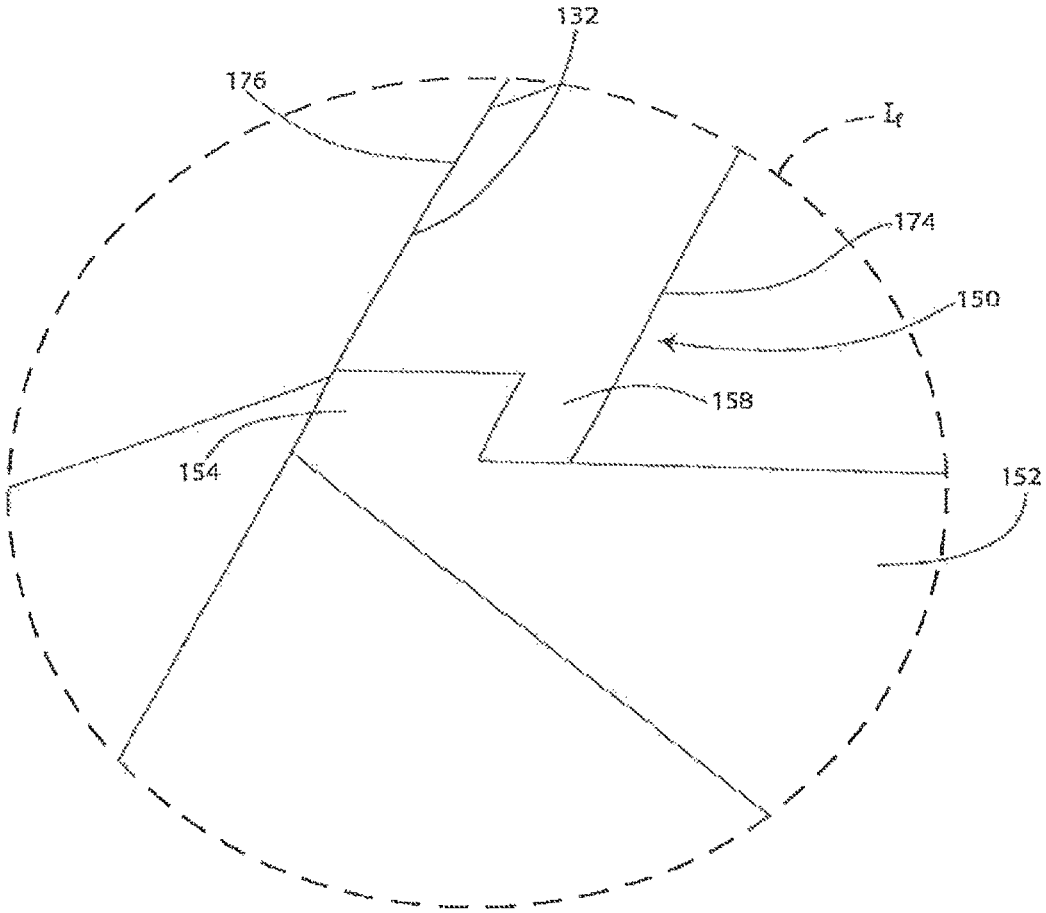
FIG. 1*f* is an enlarged cross-sectional view of a detail $I_f$ of FIG. 1*e*.
Figure 1G:
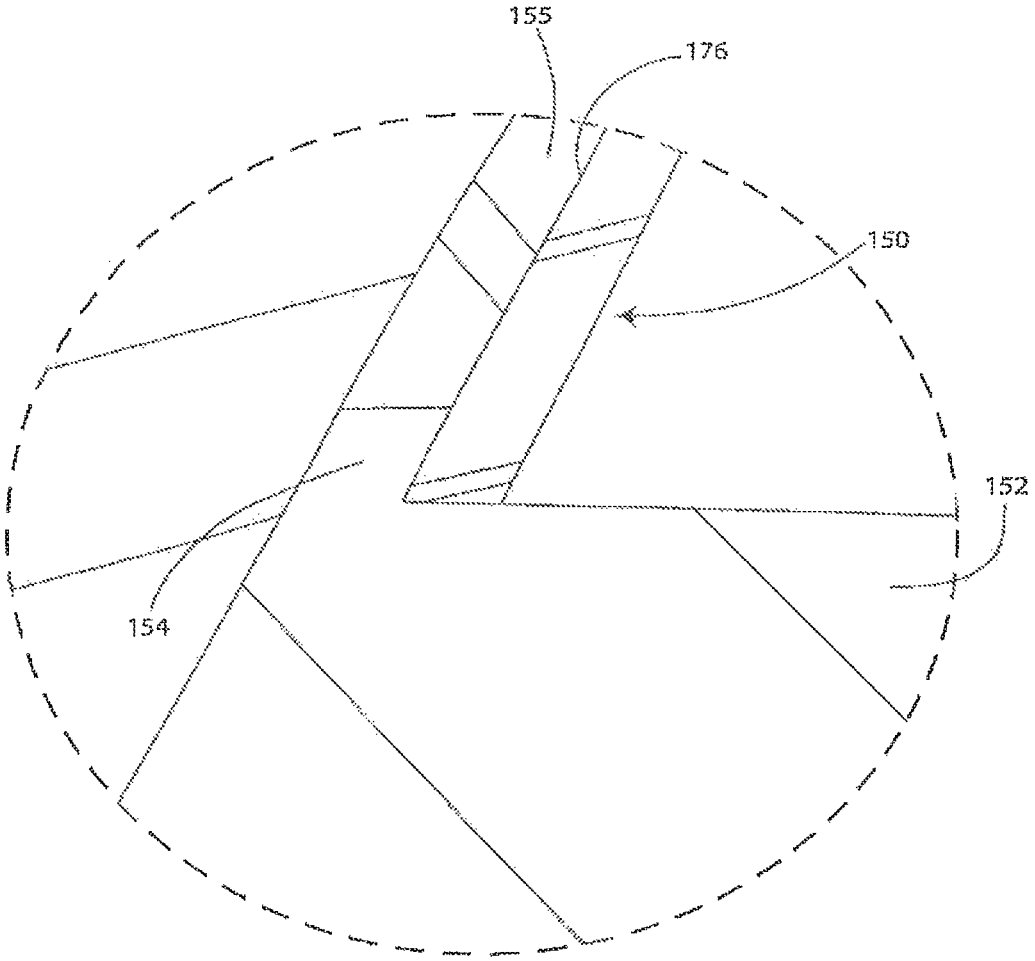
FIG. 1*g* is an enlarged cross-sectional view of an exemplary golf club head according to one or more aspects of the present invention.

FIGS. 1*c*-1*g* illustrate a preload spacer 150, which may serve as an example of a "second insert" or "metallic insert," that is contiguous with the rear wall 132 of the club head. As shown in FIGS. 1*e* and 1*f*, the preload spacer 150 may include an anterior surface 174 and a posterior surface 176 that is bonded to the rear wall 132 by, e.g., an epoxy-type adhesive. To provide positive reinforcement of the adhesive coupling between the resilient component 152 and the club head 100, a portion of the preload spacer 150, e.g., a flange 158 or "protrusion," may engage the projection 154 of the resilient component 152, such that at least a part of the resilient component 152 is compressed between the preload spacer 150 and the perimeter-weighting element 140. The compression fit of the resilient component between the spacer 150 and at least a portion of the perimeter-weighting element promotes improved damping characteristics of the club head. In another example of the present invention, illustrated in FIG. 1*g*, an adhesive layer 155 may be applied to only a portion of the posterior surface 176. The segment of the preload spacer 150 that is dissociated from by the adhesive 155 may engage the projection 154 of the resilient component 152.

Preferably, the preload spacer 150 is at least partially formed from a rigid metallic and/or non-metallic material, e.g., aluminum, titanium, ABS, fiber reinforced plastic, or poly-vinyl chloride (PVC). In one example, the preload spacer 150 may be a constrained-layer damper includes at least one constraining member, e.g., a rigid aluminum-alloy plate, and a visco-elastic layer, e.g., 3M™ VHB™ Adhesive Transfer Tape 9469.

Figure 2A:
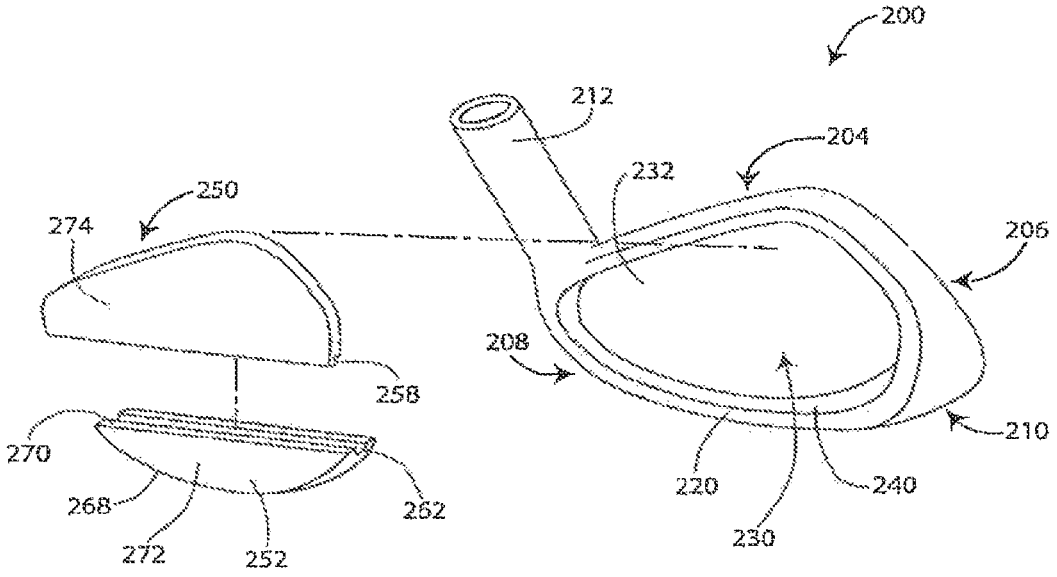
FIG. 2*a* is an exploded view of an exemplary golf club head according to one or more aspects of the present invention.
Figure 2B:
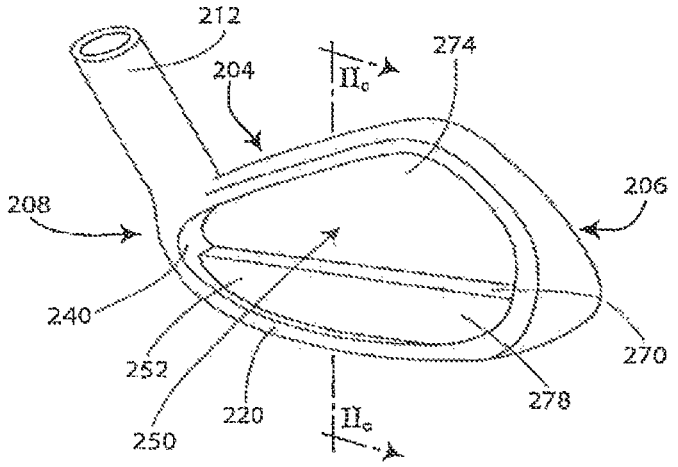
FIG. 2*b* is a rear perspective view of the golf club head of FIG. 2*a*.
Figure 2C:
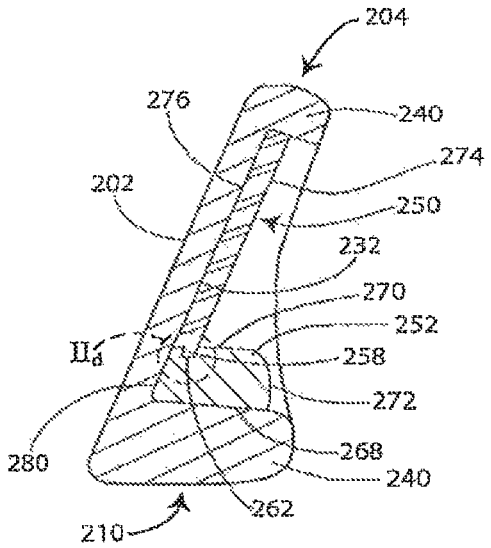
FIG. 2*c* is a cross-sectional view taken along the lines $II_c$-$II_c$ of FIG. 2*b*.

In another example, illustrated in FIGS. 2*a* and 2*c*, a golf club head 200, according to one or more aspects of the present invention, may generally include a strike face 202, a top line 204, a bottom portion 210, a heel 208, a toe 206, and a hosel 212 for receiving a shaft (not shown). The club head 200 may further include a main cavity 230, which is delimited by a rear wall 232 surrounded, at least in part, by a perimeter-weighting element 240 that includes a rear surface 220. A resilient component 252 may be associated with the perimeter-weighting element 240, e.g., to improve the dynamic-excitation response of the club head 200. The resilient component 252 may include a top surface 270, a bottom surface 268, a front surface 272, and a back surface 280 (FIG. 2*c*). Preferably, the bottom surface 268 of the resilient component 252 is coupled to the perimeter-weighting element 240, e.g., by adhesive bonding. In one example of the present invention, the top surface 270 includes a recess 262 (FIGS. 2*c* and 2*d*).

Figure 2D:
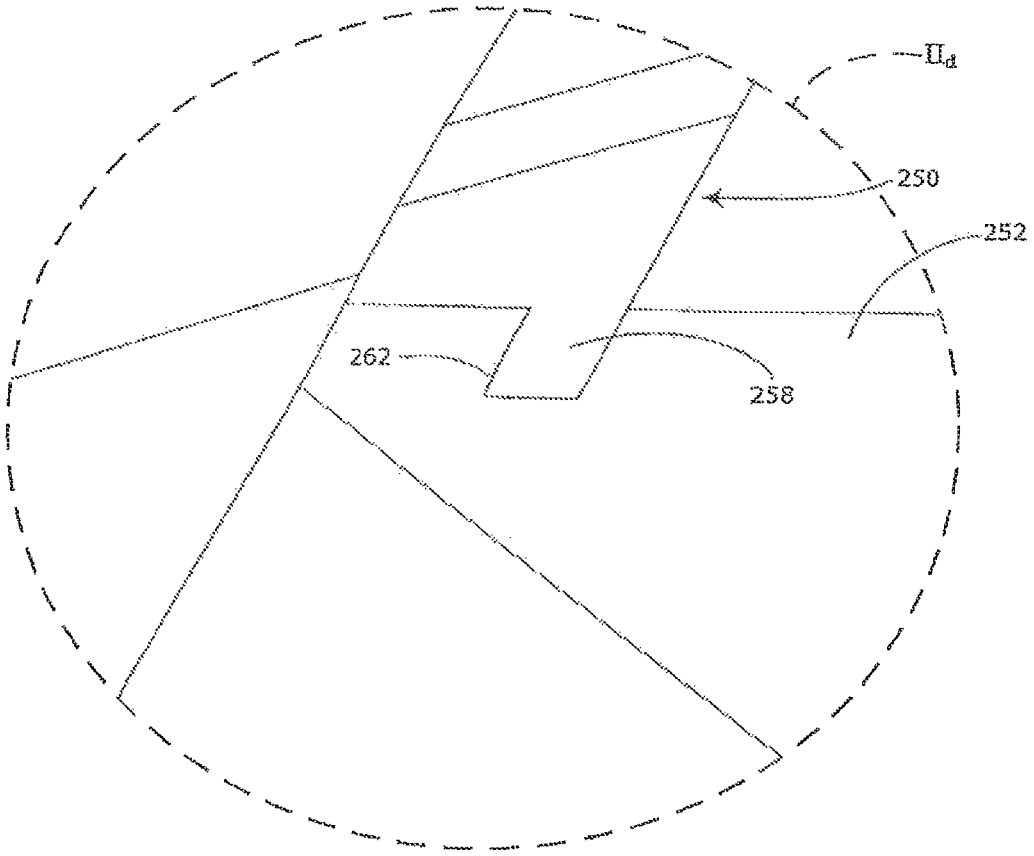
FIG. 2*d* is an enlarged cross-sectional view of a detail $II_d$ of FIG. 2*c*.

Referring to FIGS. 2*a*-2*d*, a preload spacer 250 may be disposed in the main cavity 230. The preload spacer 250 may include an anterior surface 274 and a posterior surface 276 that is coupled to the rear wall 232, e.g., by an adhesive bond. As shown in FIGS. 2*c* and 2*d*, a portion of the preload spacer 250, e.g., a flange 258, may be disposed in the recess 262, whereby the preload spacer 250 biases the resilient component 252 against a portion of the perimeter-weighting element 240 to provide positive reinforcement of the adhesive coupling between the resilient component and the club head 200.

Figure 3A:
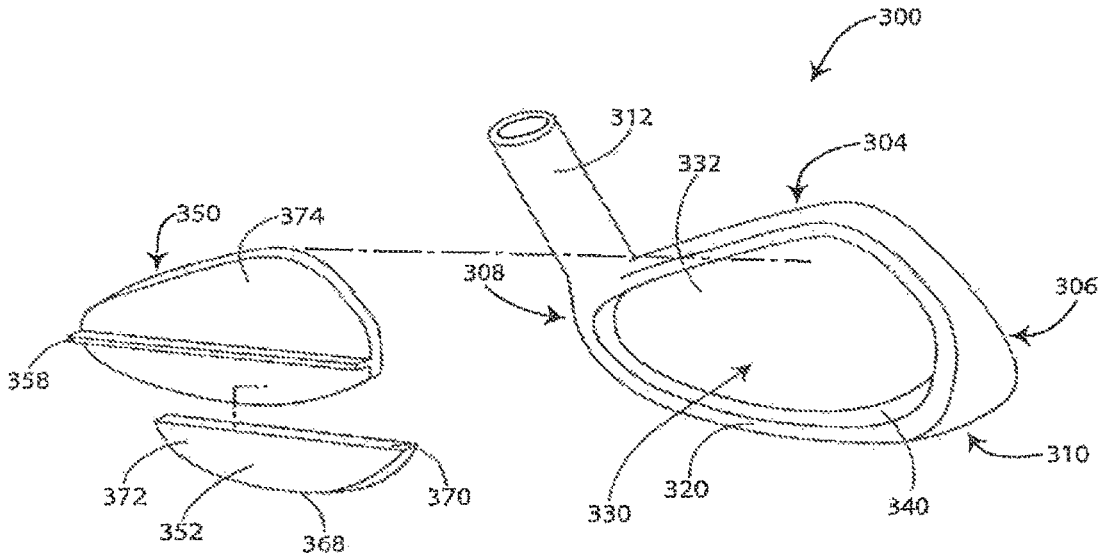
FIG. 3*a* is an exploded view of an exemplary golf club head according to one or more aspects of the present invention.
Figure 3B:
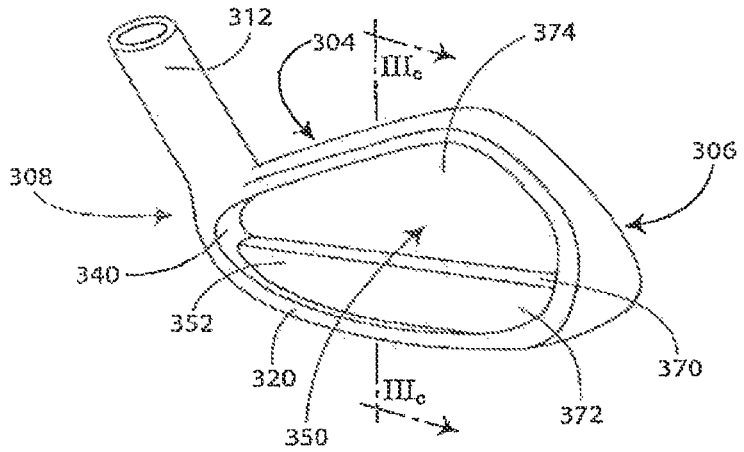
FIG. 3*b* is a rear perspective view of the golf club head of FIG. 3*a*.
Figure 3C:
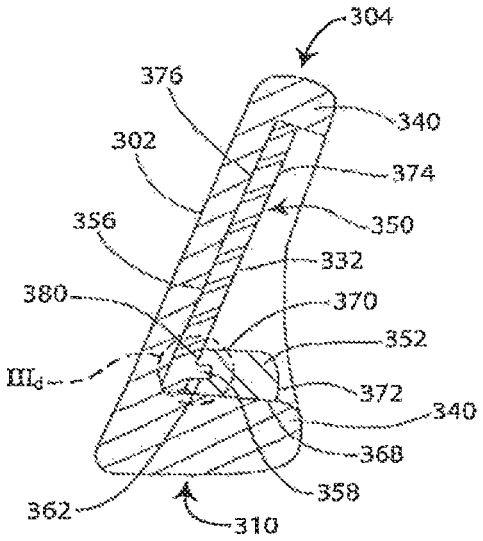
FIG. 3*c* is a cross-sectional view taken along the lines $III_c$-$III_c$ of FIG. 3.*b*
Figure 3D:
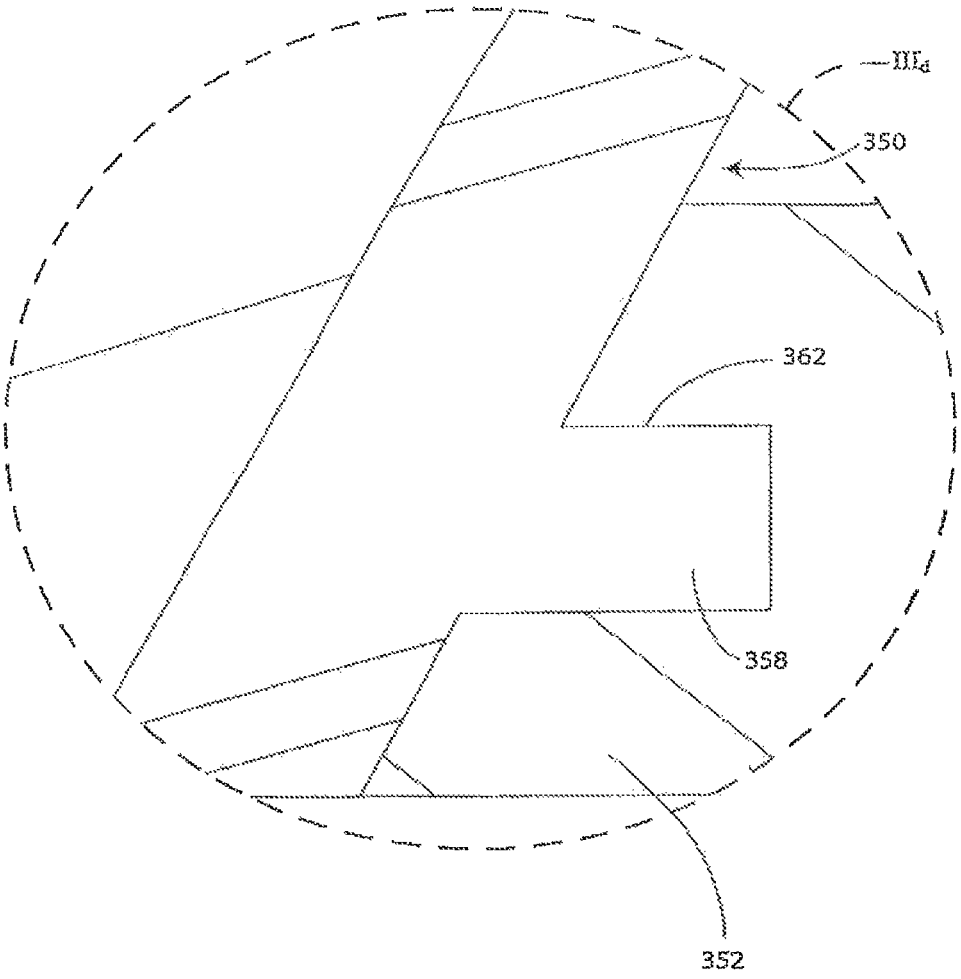
FIG. 3*d* is an enlarged cross-sectional view of a detail $III_d$ of FIG. 3*c*.

In another example, shown in FIGS. 3*a*-3*d*, a golf club head 300, according to one or more aspects of the present invention, may generally include a strike face 302, a top line 304, a bottom portion 310, a heel 308, a toe 306, and a hosel 312 for receiving a shaft (not shown). The club head 300 may further include a main cavity 330, which is delimited by a rear wall 332 surrounded, at least in part, by a perimeter-weighting element 340 that includes a rear surface 320. A resilient component 352 may be associated with the perimeter-weighting element 340, e.g., to improve the dynamic-excitation response of the club head 300. The resilient component 352 may include a top surface 370, a bottom surface 368, a front surface 372, and a back surface 380 (FIG. 3*c*). Preferably, the bottom surface 368 of the resilient component 352 is coupled to the perimeter-weighting element 340, e.g., by adhesive bonding. In one example of the present invention, the back surface 380 includes a recess 362 (FIGS. 3*c* and 3*d*).

Referring to FIGS. 3*b* and 3*c*, a preload spacer 350 may be disposed in the main cavity 330. The preload spacer 350 may include an anterior surface 374 and a posterior surface 376 that is coupled to the rear wall 332, e.g., by an adhesive bond. The back surface 380 of the resilient component 352 may preferably be contiguous with a portion of the anterior surface 374 and spaced or dissociated from the rear wall 332. As shown in FIGS. 3*c* and 3*d*, the preload spacer 350 may include a flange 358 that extends from the anterior surface 374 and interlocks with the recess 362 to provide positive reinforcement of the adhesive coupling between the resilient component 352 and the club head 300.

Figure 4A:
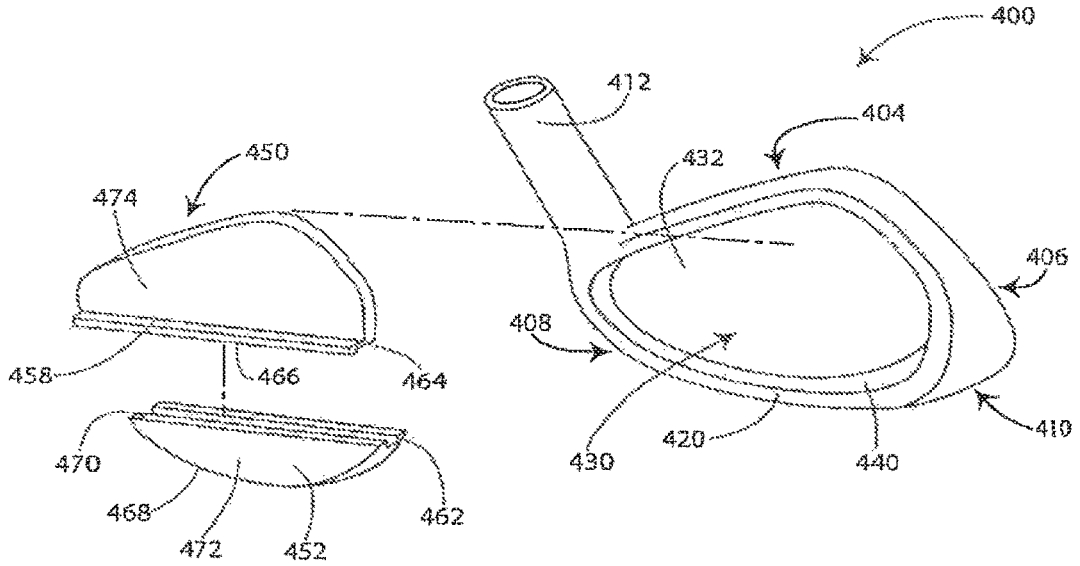
FIG. 4*a* is an exploded view of an exemplary golf club head according to one or more aspects of the present invention.
Figure 4B:
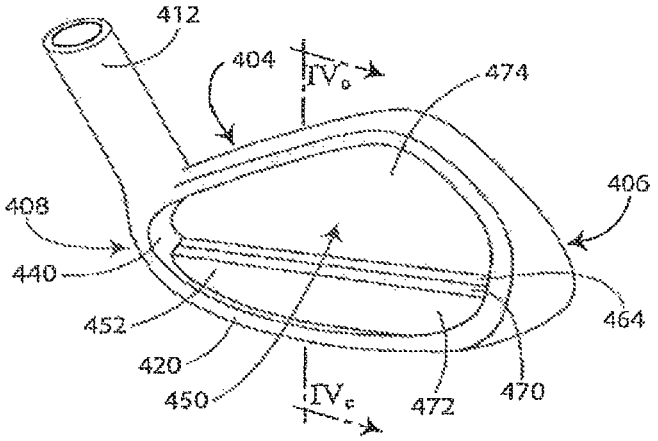
FIG. 4*b* is a rear perspective view of the golf club head of FIG. 4*a*.
Figure 4C:
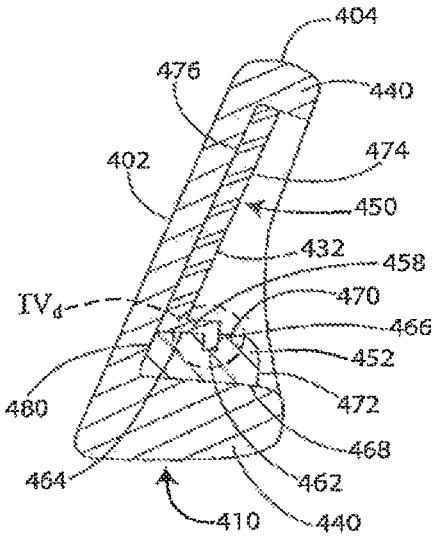
FIG. 4*c* is a cross-sectional view taken along the lines $IV_c$-$IV_c$ of FIG. 4*b*.
Figure 4D:
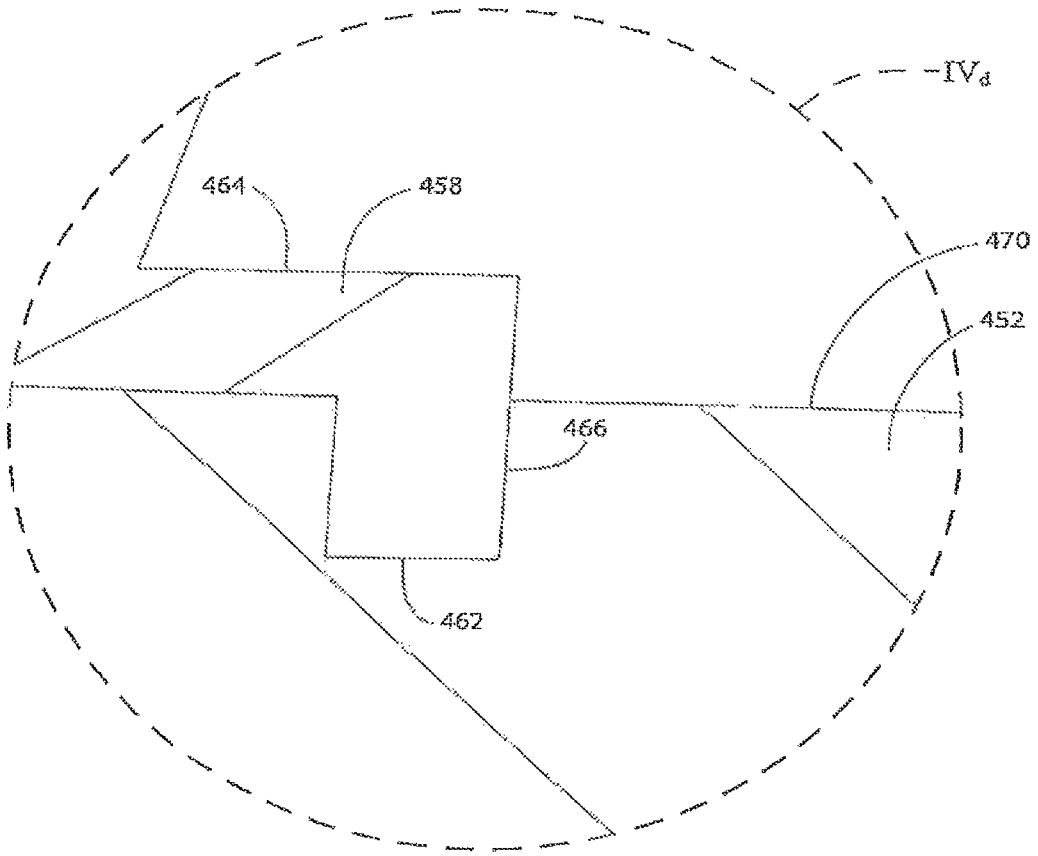
FIG. 4*d* is an enlarged cross-sectional view of a detail $IV_d$ of FIG. 4*c*.

With reference to FIGS. 4*a*-4*d*, a golf club head 400, according to one or more aspects of the present invention, may generally include a strike face 402, a top line 404, a bottom portion 410, a heel 408, a toe 406, and a hosel 412 for receiving a shaft (not shown). The club head 400 may further include a main cavity 430, which is delimited by a rear wall 432 surrounded, at least in part, by a perimeter-weighting element 440 that includes a rear surface 420. A resilient component 452 may be associated with the perimeter-weighting element 440, e.g., to improve the dynamic-excitation response of the club head 400. The resilient component 452 may include a top surface 470, a bottom surface 468, a front surface 472, and a back surface 480 (FIG. 4*c*). Preferably, the bottom surface 468 of the resilient component 452 is coupled to the perimeter-weighting element 440, e.g., by adhesive bonding. In one example of the present invention, the top surface 470 includes a recess 462 (FIGS. 4*c* and 4*d*).

Referring to FIGS. 4*b* and 4*c*, a preload spacer 450 may be disposed in the main cavity 430. The preload spacer 450 may include an anterior surface 474 and a posterior surface 476 that is coupled to the rear wall 432, e.g., by an adhesive bond. The preload spacer 450 may further include a generally L-shaped flange 458, having a protruding portion 464 and a retaining portion 466. As shown in FIGS. 4*c* and 4*d*, the protruding portion 464 may be contiguous with a portion of the top surface 470, and the retaining portion 466 may be at least partially disposed in the recess 462. The preload spacer 450 biases the resilient component 452 against a portion of the perimeter-weighting element 440 to provide positive reinforcement of the adhesive coupling between the resilient component and the club head 400.

Figure 5A:
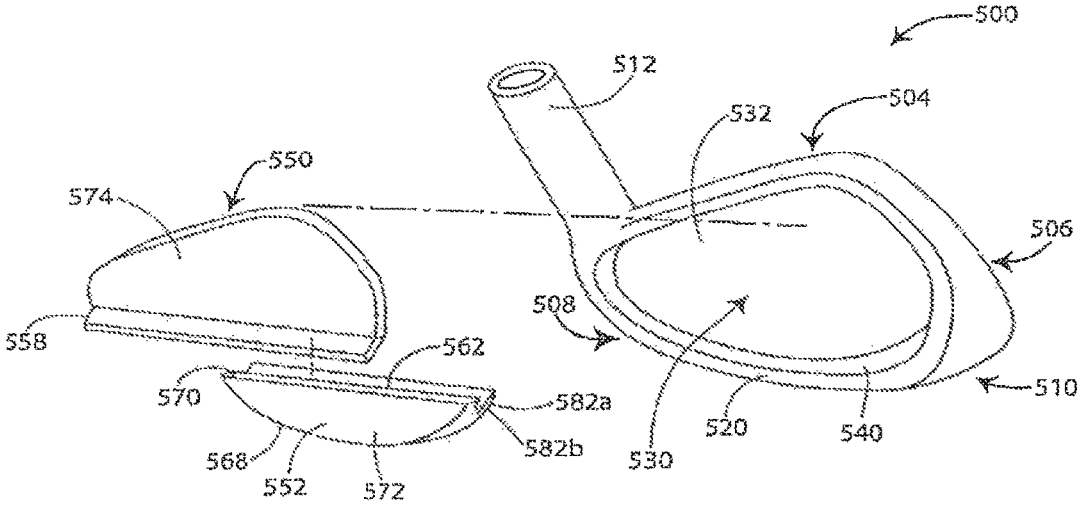
FIG. 5*a* is an exploded view of an exemplary golf club head according to one or more aspects of the present invention.
Figure 5B:
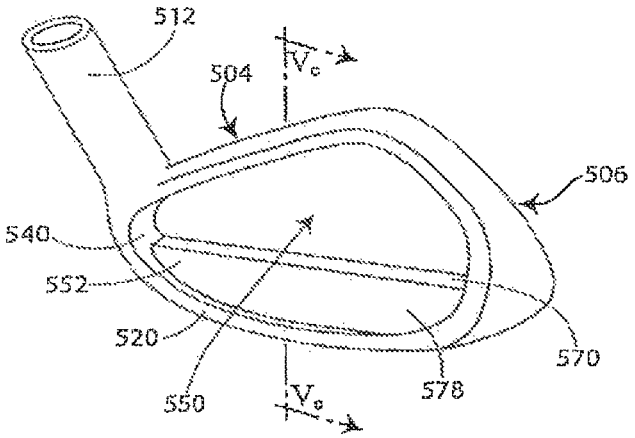
FIG. 5*b* is a rear perspective view of the golf club head of FIG. 5*a*.
Figure 5C:
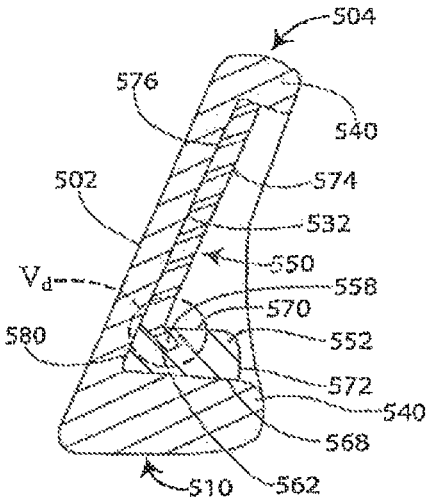
FIG. 5*c* is a cross-sectional view taken along the lines $V_c$-$V_c$ of FIG. 5*b*.
Figure 5D:
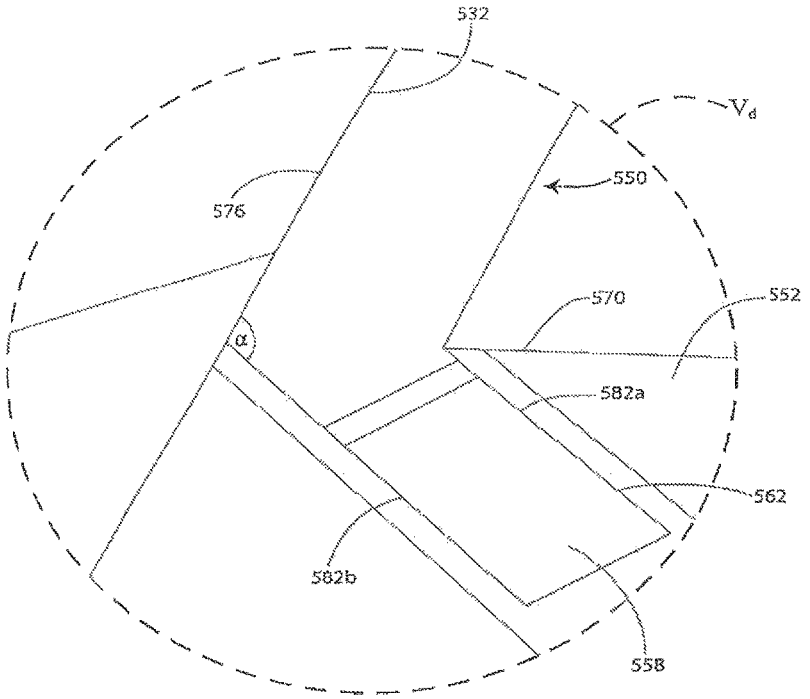
FIG. 5*d* is an enlarged cross-sectional view of a detail $V_d$ of FIG. 5*c*.

With reference to FIGS. 5*a*-5*d*, a golf club head 500, according to one or more aspects of the present invention, may generally include a strike face 502, a top line 504, a bottom portion 510, a heel 508, a toe 506, and a hosel 512 for receiving a shaft (not shown). The club head 500 may further include a main cavity 530, which is delimited by a rear wall 532 surrounded, at least in part, by a perimeter-weighting element 540 that includes a rear surface 520. A resilient component 552 may be associated with the perimeter-weighting element 540, e.g., to improve the dynamic-excitation response of the club head 500. The resilient component 552 may include a top surface 570, a bottom surface 568, a front surface 572, and a back surface 580 (FIG. 5*c*). Preferably, the bottom surface 568 of the resilient component 552 is coupled to the perimeter-weighting element 540, e.g., by adhesive bonding. In one example of the present invention, the top surface 570 includes an oblique recess 562 (FIGS. 5*c* and 5*d*). As shown in FIG. 5*d*, the recess 562 may include two walls 582*a* and 582*b*, oriented, e.g., at an angle α, e.g., between about 90° and about 170°, relative to the rear wall 532.

Referring to FIGS. 5*b* and 5*c*, a preload spacer 550 may be disposed in the main cavity 530. The preload spacer 550 may include a substantially planar anterior surface 574 and a posterior surface 576, coupled to the rear wall 532, e.g., by adhesive bonding. As shown in FIG. 5*d*, a portion of the preload spacer 550, e.g., a flange 558, engages the recess 562, whereby the preload spacer 550 biases the resilient component 552 against a portion of the perimeter-weighting element 540 to provide positive reinforcement of the adhesive coupling between the resilient component and the club head 500. Preferably, the flange 558 is oriented at an angle a between about 90° and about 170° relative to the rear wall 532. More preferably, the flange may be oriented at an angle a between about 100° and about 150° relative to the rear wall 532.

Figure 6:
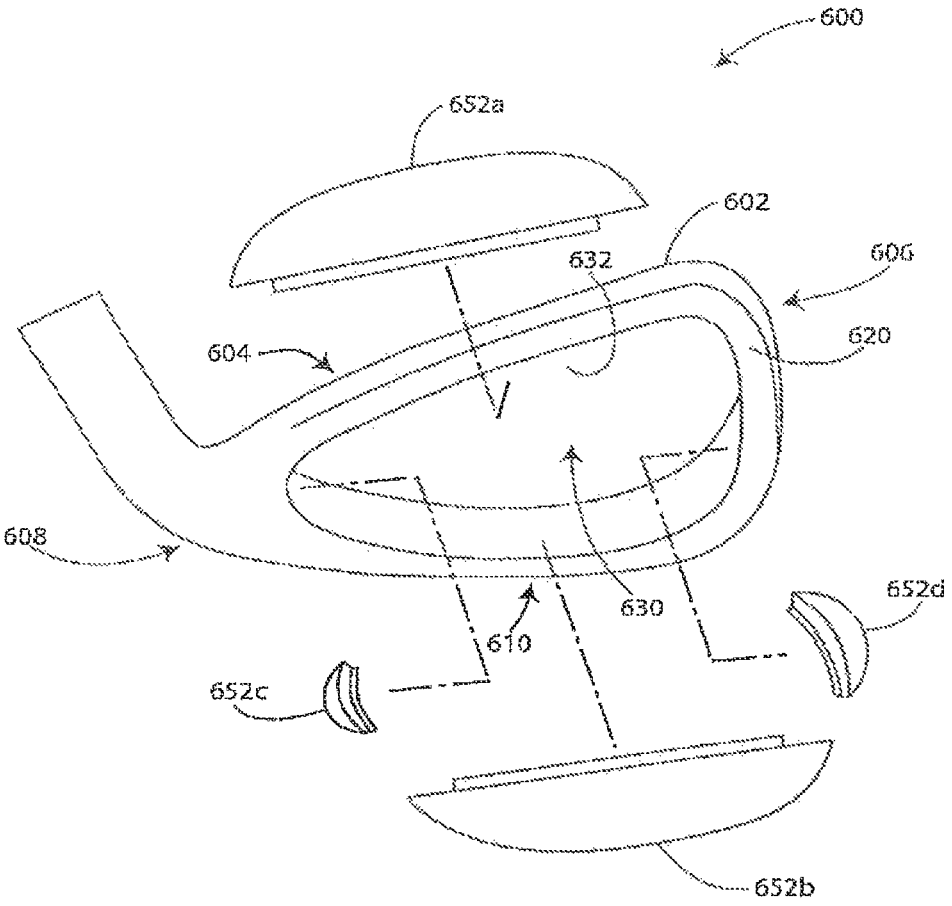
FIG. 6 is an exploded view of an exemplary golf club head according to one or more aspects of the present invention.

As illustrated in FIG. 6, a golf club head 600, according to one or more aspects of the present invention, may generally include a strike face 602, a top line 604, a bottom portion 610, a heel 608, and a toe 606. The club head 600 may further include a main cavity 630, which is delimited by a rear wall 632 surrounded, at least in part, by a perimeter-weighting element 640 that includes a rear surface 620. At least one resilient component, e.g., resilient components 652*a*-*d*, may be associated with the perimeter-weighting element 640 proximate at least one of the top line 604, the bottom portion 610, the heel 608, and the toe 606. A preload spacer (not shown), similar to, e.g., the preload spacer 150, described above, may be disposed in the main cavity 630 and may interlock with the at least one resilient component to provide positive reinforcement of the coupling between the club head and the at least one resilient component.

In the foregoing specification, the invention has been described with reference to specific exemplary aspects thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. An iron-type golf club head comprising:

a striking wall having a strike face and a rear surface opposite the strike face;

a perimeter-weighting element located about the periphery of the rear surface and forming a rear cavity;

a resilient insert comprising a recess, the resilient insert being located within the rear cavity and abutting the perimeter-weighting element and the rear surface of the striking wall; and a constraining member comprising a rigid metallic material and having a retaining portion that is disposed at least partially in the recess of the resilient insert such that a portion of the resilient insert is in a compressed state.

2. The iron-type golf club head of claim 1, wherein the resilient insert comprises a durometer hardness of less than about 100 Shore A.

3. The iron-type golf club head of claim 2, wherein the resilient insert comprises a durometer hardness of less than about 80 Shore A.

4. The iron-type golf club head of claim 1, wherein the resilient insert comprises a polymeric material.

5. The iron-type golf club head of claim 4, wherein the polymeric material is selected from the group consisting of: polyurethane, silicone, acrylonitrile butadiene styrene, Nylon, polycarbonate, polypropylene, polyethylene, thermoplastic rubber, thermoplastic vulcanizate, thermoplastic elastomers, and natural rubber.

6. The iron-type golf club head of claim 1, wherein the resilient insert contacts the perimeter-weighting element.

7. The iron-type golf club head of claim 1, wherein the resilient insert is adhesively coupled to the rear surface of the striking wall.

8. The iron-type golf club head of claim 1, wherein the resilient insert comprises a specific gravity of between 0.8 and 2.0.

9. The iron-type golf club head of claim 1, wherein the recess is located in a surface of the resilient insert facing at least one of the striking wall and the perimeter weighting element.

10. An iron-type golf club head comprising:

a striking wall having a strike face and a rear surface opposite the strike face;

a perimeter-weighting element located about the periphery of the rear surface and forming a rear cavity;

a resilient insert located within the rear cavity and abutting the rear surface of the striking wall, the resilient insert comprising a recess and a polymeric material densified by being blended with a second material having a higher density than the polymeric material; and a constraining member comprising a rigid metallic material and having a retaining portion that is disposed at least partially in the recess of the resilient insert such that a portion of the resilient insert is in a compressed state.

11. The iron-type golf club head of claim 10, wherein the resilient insert comprises a durometer hardness of less than about 100 Shore A.

12. The iron-type golf club head of claim 11, wherein the resilient insert comprises a durometer hardness of less than about 80 Shore A.

13. The iron-type golf club head of claim 10, wherein the polymeric material is selected from the group consisting of: polyurethane, silicone, acrylonitrile butadiene styrene, Nylon, polycarbonate, polypropylene, polyethylene, thermoplastic rubber, thermoplastic vulcanizate, thermoplastic elastomers, and natural rubber.

14. The iron-type golf club head of claim 10, wherein the resilient insert contacts the perimeter-weighting element.

15. The iron-type golf club head of claim 10, wherein the resilient insert is adhesively coupled to the rear surface of the striking wall.

16. The iron-type golf club head of claim 10, wherein the second material comprises tungsten.

17. The iron-type golf club head of claim 10, wherein the resilient insert comprises a specific gravity of between 0.8 and 2.0.

* * * * *